US009515438B1

(12) United States Patent
Chang

(10) Patent No.: US 9,515,438 B1
(45) Date of Patent: Dec. 6, 2016

(54) ELECTRICAL CONNECTOR WITH IMPROVED TERMINAL SET

(71) Applicant: T-CONN PRECISION CORPORATION, New Taipei (TW)

(72) Inventor: Jen-Hao Chang, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 0 days.

(21) Appl. No.: 14/983,692

(22) Filed: Dec. 30, 2015

(30) Foreign Application Priority Data

Aug. 3, 2015 (TW) ..... 104212425 U

(51) Int. Cl.
*H01R 13/60* (2006.01)
*H01R 24/64* (2011.01)

(52) U.S. Cl.
CPC ..... *H01R 24/64* (2013.01)

(58) Field of Classification Search
CPC ..... H01R 23/7073; H01R 23/7026
USPC ..... 439/541.5, 79, 567
See application file for complete search history.

(56) References Cited

U.S. PATENT DOCUMENTS 8,187,039 B2 * 5/2012 Tsai ..... H01R 27/00 439/541.5
8,545,273 B1 * 10/2013 Chen ..... H01R 13/6658 439/660
2002/0042223 A1 * 4/2002 Belopolsky ..... H01R 13/7195 439/541.5
2003/0008553 A1 * 1/2003 Oleynick ..... H01R 12/716 439/541.5
2008/0166918 A1 * 7/2008 Yang ..... H01R 13/65802 439/607.05
2011/0039451 A1 * 2/2011 Tung ..... H01R 24/62 439/620.23

* cited by examiner

*Primary Examiner* — Phuongchi T Nguyen
(74) *Attorney, Agent, or Firm* — Bacon & Thomas, PLLC

(57) ABSTRACT

An electrical connector with improved terminal set comprising having an insulation seat; a first and a second terminal sets joined respectively with the insulation seat, the first and the second terminal sets comprising having respectively an alignment terminal, multiple first terminals and multiple second terminals, each of the alignment terminal, the first and the second terminals having a contacting portion, a bending portion and a welding portion; each of the first and the second terminals being provided respectively on two sides of each of the alignment terminals, and the contacting portion and the bending portion for each of the first and the second terminals having a deflecting portion connected therebetween; and a metal shell covering the insulation seat, the first terminal set and the second terminal set.

10 Claims, 10 Drawing Sheets

ELECTRICAL CONNECTOR WITH IMPROVED TERMINAL SET

BACKGROUND OF THE INVENTION

Field of the Invention

The invention is an electrical connector with improved terminal set, and particularly relates to one which may utilize disposition of each deflecting portion for solid joining with an insulation seat when each of the first and second terminals are joined with the insulation seat in order for each of the first and the second terminals to proceed to a subsequent bending process, so that the effects of a stable consecutive post process and better control of high frequency characteristics are achieved.

Descriptions of the Related Art

Conventionally, U.S. Pat. No. 7,857,665 B2, entitled "Electrical Connector with Improved Contact Arrangement", includes an insulative housing, a set of first contacts retained in the insulative housing, and a metal shell fixed to the insulative housing; the insulative housing including a base portion and a tongue plate protruding into a receiving space from the base portion; some first passageways being defined on a first surface of the tongue plate; the first contacts including first contacting sections received in the first passageways, first bending sections extending downwardly from the first contacting sections, and first tail sections extending from the first bending sections, the first contacting sections being arranged in a single row and being distributed essentially evenly over the first surface, the first bending sections including a plurality of first offset sections and at least one second offset section, the metallic shell being fixed to the base portion and enclosing the tongue plate, a first slope of each first offset section being of one of positive and negative numbers while a second slope of the second offset section being of the rest of the positive and negative numbers, such that a space between each adjacent two first tail sections being much larger than that of the corresponding first contacting sections for preventing the first tail sections from soldering confusion, and in turn, the effect for easy soldering of the first tail sections is achieved.

The above conventional prior art achieves the effect of easy soldering for the first tail sections. However, the terminals are joined with the insulative housing by means of insert molding, and the joined terminals are in a straight non-bending state, while each of the first and the second offset sections is provided outside of the insulative housing for the conventional structure, so that the bending formation is difficult during bending process because of the limitation to the shapes of the first and the second offset sections when the terminals proceed to a subsequent bending process with the first bending sections and the second bending sections, therefore the terminals will appear as a non-straight configuration due to the arrangement of the first and the second offset sections after bending, such that the performance of the terminals are not easy to control, and there is the issue of unstable high frequency characteristics for the terminals. Thus, there is insufficiency for the prior art in practical applications.

In view of this, the inventor has researched and developed an electrical connector with improved terminal set in order to improve the above conventional technology with respect to various shortages thereof.

SUMMARY OF THE INVENTION

For a major objective of the invention, each of the first and the second terminals is allowed to spread from the deflecting portion on the top for the insulation seat to form a smaller spreading region when joining with each of the first and the second terminals by means of insert molding, such that the punching production process can be controlled easily, and in turn, disposition of each of the deflecting portions is utilized for solid joining with the insulation seat, and the bending portion is allowed to be bended in a straight manner during a consecutive post process in order to proceed to a subsequent bending process for each of the first and the second terminals, such that the effects with respect to a more stable production and better control of high frequency characteristics are accomplished.

In order to achieve the above objective, the invention is an electrical connector with improved terminal set including an insulation seat; a first and a second terminal sets joined respectively with the insulation seat, the first and the second terminal sets comprising respectively an alignment terminal, multiple first terminals and multiple second terminals, each of the alignment terminal, the first and the second terminals having a contacting portion, a bending portion and a welding portion, each of the first and the second terminals being provided respectively on two sides of each of the alignment terminals, and the contacting portion and the bending portion for each of the first and the second terminals having a deflecting portion connected therebetween; and a metal shell covering the insulation seat, the first terminal set and the second terminal set.

In the preferred embodiment, the insulation seat comprises a seat, a tongue plate provided on an end surface of the seat, multiple first passageways and second passageways provided respectively in the seat and in communication with a top surface and a bottom surface of the tongue plate, and multiple heat dissipating holes provided on the tongue plate, while the alignment terminal, the first terminals and the second terminals of the first terminal set being retained respectively in each of the first passageways, and the alignment terminal, the first terminals and the second terminals of the second terminal set being retained respectively in each of the second passageways.

In the preferred embodiment, the contacting portion of the alignment terminal provided by the first terminal set is provided on the top surface of the tongue plate, and part of the contacting portion is located in the first passageways of the seat, the bending portion and the welding portion thereof extending out of the seat.

In the preferred embodiment, the contacting portion of each of the first and the second terminals provided by the first terminal set is provided on the top surface of the tongue plate, and the deflecting portion is located in the first passageways of the seat, the bending portion and the welding portion thereof extending out of the seat.

In the preferred embodiment, the contacting portion of the alignment terminal provided by the second terminal set is provided on the bottom surface of the tongue plate, and part of the contacting portion is located in the second passageways of the seat, the bending portion and the welding portion thereof extending out of the seat.

In the preferred embodiment, the contacting portion of each of the first and the second terminals provided by the second terminal set is provided on the bottom surface of the tongue plate, and the deflecting portion is located in the second passageways of the seat, the bending portion and the welding portion thereof extending out of the seat.

In the preferred embodiment, the bending portion and the welding portion of part of the first terminals and part of the second terminals for the first terminal set have a respective flat portion provided therebetween which is capable of being used for signal transmission.

In the preferred embodiment, the deflecting portion of each of the first terminals provided by the first terminal set is inclined to one side of the alignment terminal, while the deflecting portion of each of the second terminals provided by the first terminal set is inclined to the other side of the alignment terminal.

In the preferred embodiment, the bending portion and the welding portion of the alignment terminal, part of the first terminals and part of the second terminals for the second terminal set have a flat portion provided respectively therebetween which is capable of being used for signal transmission.

In the preferred embodiment, the deflecting portion of each of the first terminals provided by the second terminal set is inclined to one side of the alignment terminal, while the deflecting portion of each of the second terminals provided by the second terminal set is inclined to the other side of the alignment terminal.

In another preferred embodiment, an electrical connector with improved terminal set according to the invention comprises: an insulation seat having a seat, a tongue plate, multiple first passageways, multiple second passageways, each of the first passageways and the second passageways being provided respectively in the seat and in communication with a top surface and a bottom surface of the tongue plate; a terminal set, which is joined with the insulation seat, comprising a first terminal set provided in the first passageways, and a second terminal set provided in the second passageways, the first and the second terminal sets comprising respectively an alignment terminal, multiple first terminals provided on one side of the alignment terminal, and multiple second terminals provided on another side of the alignment terminal, the alignment terminal comprising a portion of contacting portion in the insulation seat, a bending portion connected with the contacting portion, and a welding portion connected with the bending portion, and moreover, each of the first and the second terminals comprising respectively a contacting portion, a deflecting portion connected with the contacting portion and located in the insulation seat, a bending portion connected with the deflecting portion, and a welding portion connected with the bending portion; and a metal shell covering the insulation seat, the first terminal set and the second terminal set.

In the another preferred embodiment, the tongue plate of the insulation seat is provided with multiple heat dissipating holes thereon.

In the another preferred embodiment, the contacting portion of the alignment terminal provided by the first terminal set is provided on the top surface of the tongue plate, and part of the contacting portion is located in the first passageways of the seat, the bending portion and the welding portion thereof extending out of the seat.

In the another preferred embodiment, the contacting portion of each of the first and the second terminals provided by the first terminal set is provided on the top surface of the tongue plate, and the deflecting portion is located in the first passageways of the seat, the bending portion and the welding portion thereof extending out of the seat.

In the another preferred embodiment, the contacting portion of the alignment terminal provided by the second terminal set is provided on the bottom surface of the tongue plate, and part of the contacting portion is located in the second passageways of the seat, the bending portion and the welding portion thereof extending out of the seat.

In the another preferred embodiment, the contacting portion of each of the first and the second terminals provided by the second terminal set is provided on the bottom surface of the tongue plate, and the deflecting portion is located in the second passageways of the seat, the bending portion and the welding portion thereof extending out of the seat.

In the another preferred embodiment, the bending portion and the welding portion of part of the first terminals and part of the second terminals for the first terminal set have a respective flat portion provided therebetween which is capable of being used for signal transmission.

In the another preferred embodiment, the deflecting portion of each of the first terminals provided by the first terminal set is inclined to one side of the alignment terminal, while the deflecting portion of each of the second terminals provided by the first terminal set is inclined to the other side of the alignment terminal.

In the another preferred embodiment, the bending portion and the welding portion of the alignment terminal, part of the first terminals and part of the second terminals for the second terminal set have a flat portion provided respectively therebetween which is capable of being used for signal transmission.

In the another preferred embodiment, the deflecting portion of each of the first terminals provided by the second terminal set is inclined to one side of the alignment terminal, while the deflecting portion of each of the second terminals provided by the second terminal set is inclined to the other side of the alignment terminal.

In a further preferred embodiment, for an electrical connector with improved terminal set according to the invention, the terminal set thereof comprises: a first terminal set and a second terminal set provided beneath the first terminal set, wherein the first terminal set comprises an alignment terminal, multiple first terminals provided on one side of the alignment terminal, and multiple second terminals provided on another side of the alignment terminal, the alignment terminal comprising a contacting portion, a bending portion connected with the contacting portion, and a welding portion connected with the bending portion, and moreover, each of the first and the second terminals comprising respectively a contacting portion, a deflecting portion connected with the contacting portion, a bending portion connected with the deflecting portion, and a welding portion connected with the bending portion; furthermore, the second terminal set comprises an alignment terminal, multiple first terminals provided on one side of the alignment terminal, and multiple second terminals provided on another side of the alignment terminal, the alignment terminal comprising a contacting portion, a bending portion connected with the contacting portion, and a welding portion connected with the bending portion, and moreover, each of the first and the second terminals comprising respectively a contacting portion, a deflecting portion connected with the contacting portion, a bending portion connected with the deflecting portion, and a welding portion connected with the bending portion.

In the further preferred embodiment, the bending portion and the welding portion of part of the first terminals and part of the second terminals for the first terminal set have a respective flat portion provided therebetween which is capable of being used for signal transmission.

In the further preferred embodiment, the deflecting portion of each of the first terminals provided by the first terminal set is inclined to one side of the alignment terminal, while the deflecting portion of each of the second terminals provided by the first terminal set is inclined to the other side of the alignment terminal.

In the further preferred embodiment, the bending portion and the welding portion of the alignment terminal, part of the first terminals and part of the second terminals for the second terminal set have a flat portion provided respectively therebetween which is capable of being used for signal transmission.

In the further preferred embodiment, the deflecting portion of each of the first terminals provided by the second terminal set is inclined to one side of the alignment terminal, while the deflecting portion of each of the second terminals provided by the second terminal set is inclined to the other side of the alignment terminal.

DETAILED DESCRIPTION OF THE PREFERRED EMBODIMENT

Figure 1:
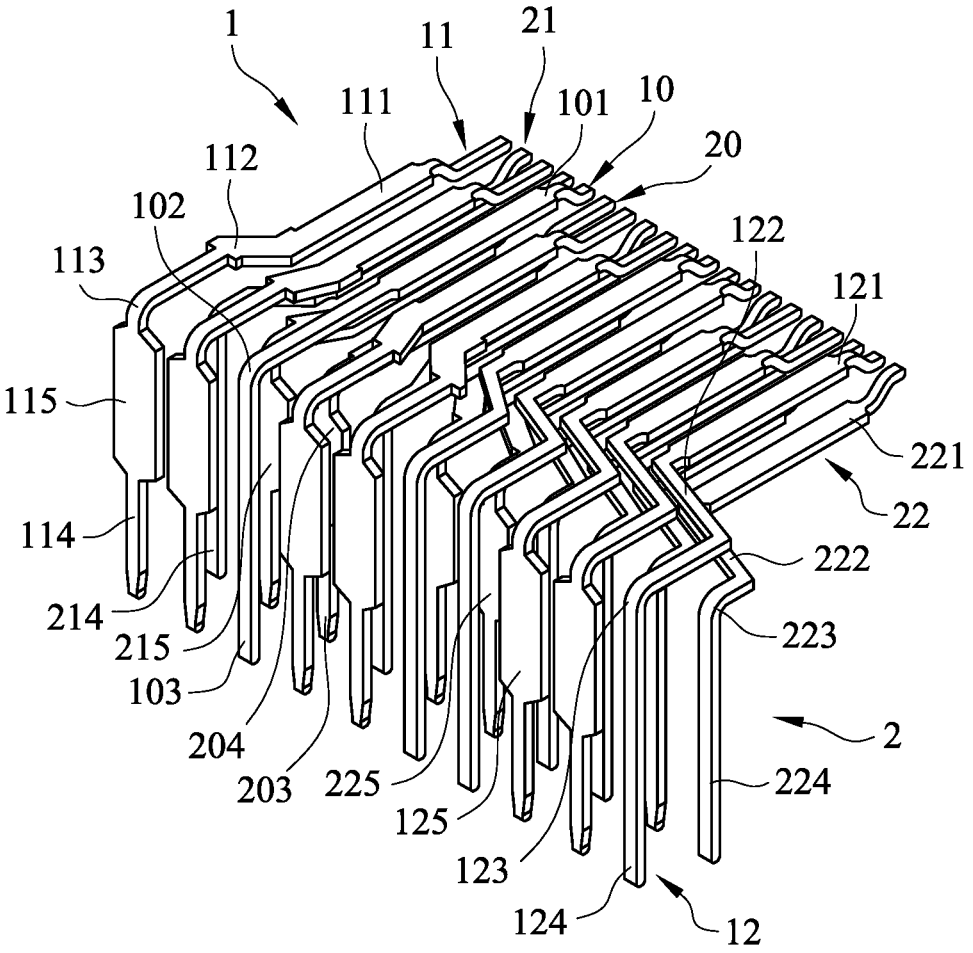
FIG. 1 is a schematic diagram showing appearance of a first and a second terminal sets according to the invention.
Figure 2:
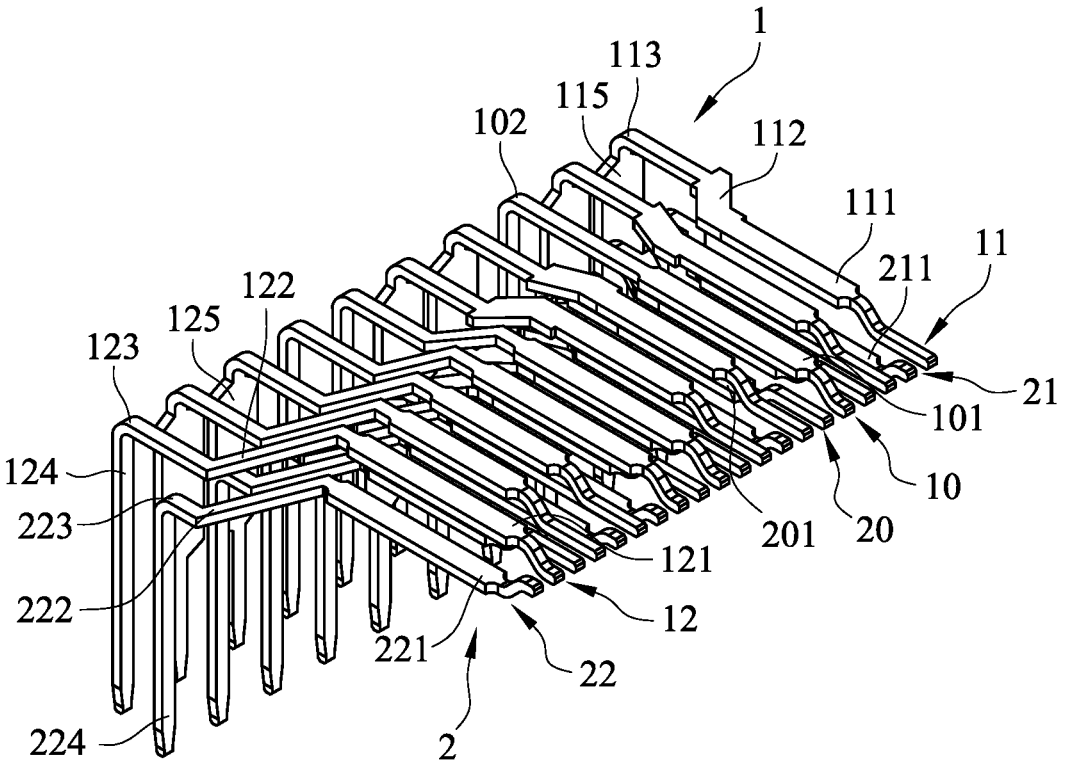
FIG. 2 is another schematic diagram showing appearance of the first and the second terminal sets according to the invention.
Figure 3:
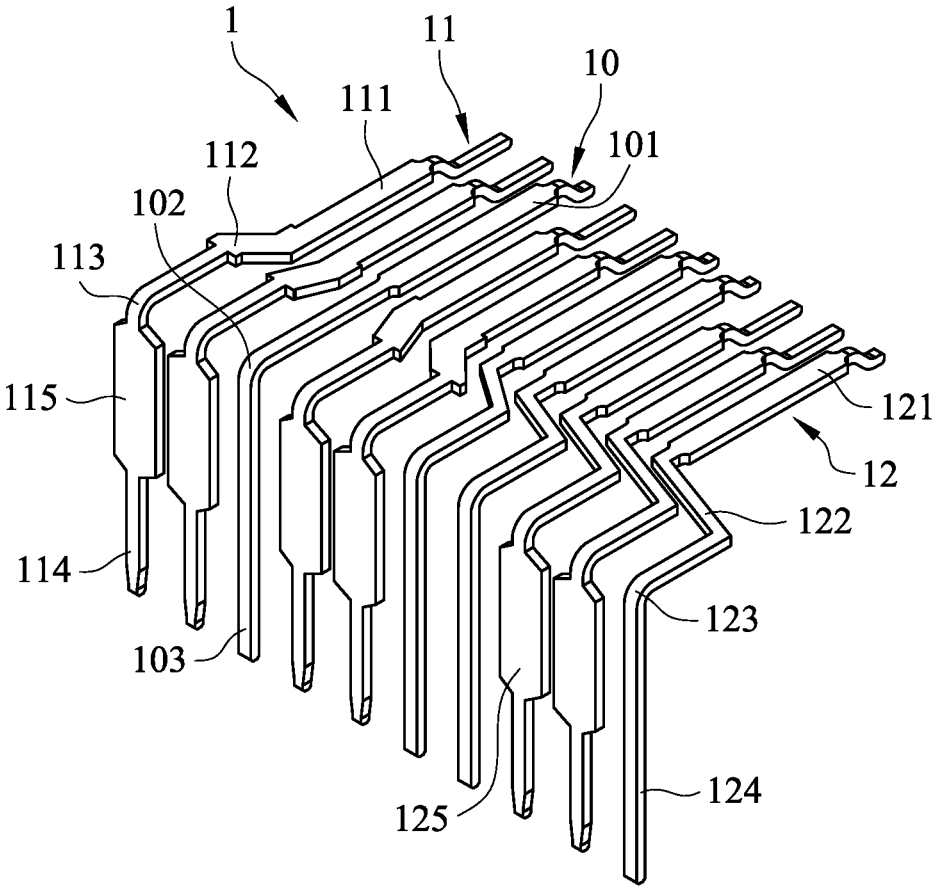
FIG. 3 is a schematic diagram showing appearance of the first terminal set according to the invention.
Figure 4:
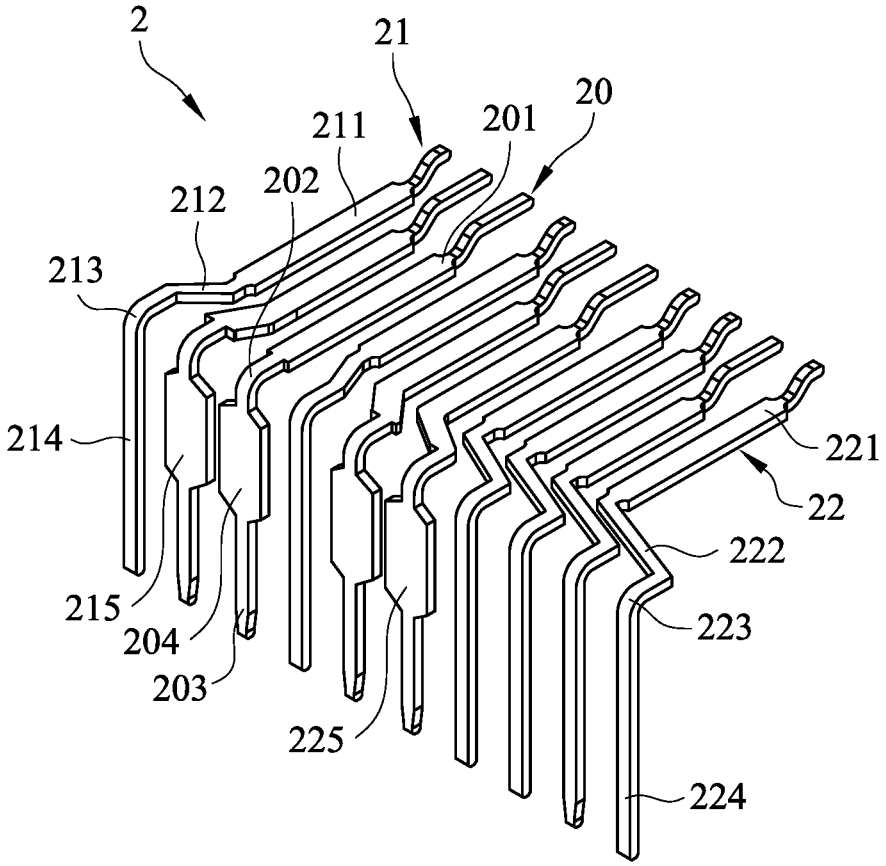
FIG. 4 is a schematic diagram showing appearance of the second terminal set according to the invention.
Figure 5:
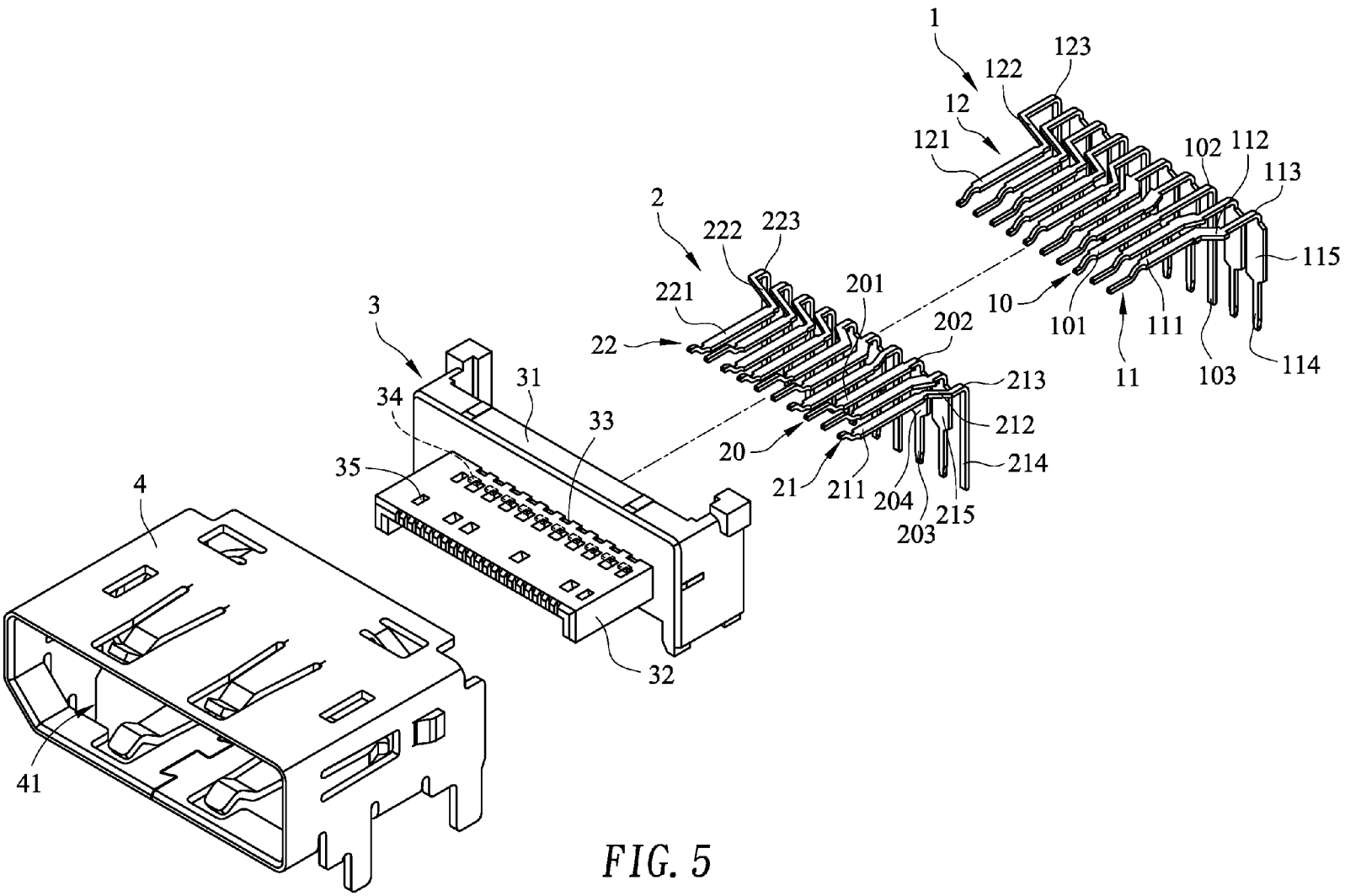
FIG. 5 is an exploded schematic diagram showing elements of the first and the second terminal sets, an insulation seat and a metal shell according to the invention.
Figure 6:
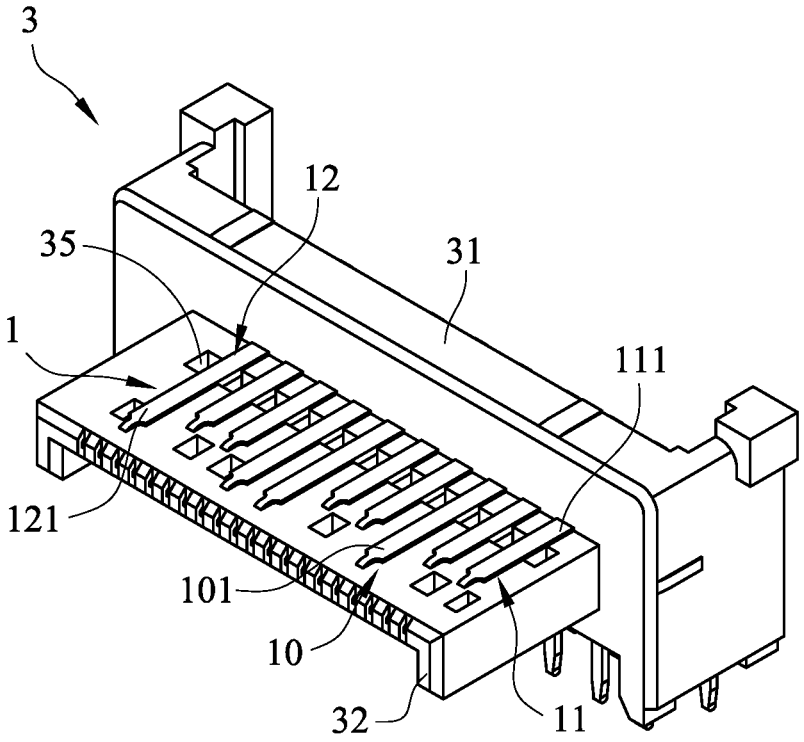
FIG. 6 is a schematic diagram showing the first and the second terminal sets after joining with the insulation seat according to the invention.
Figure 7:
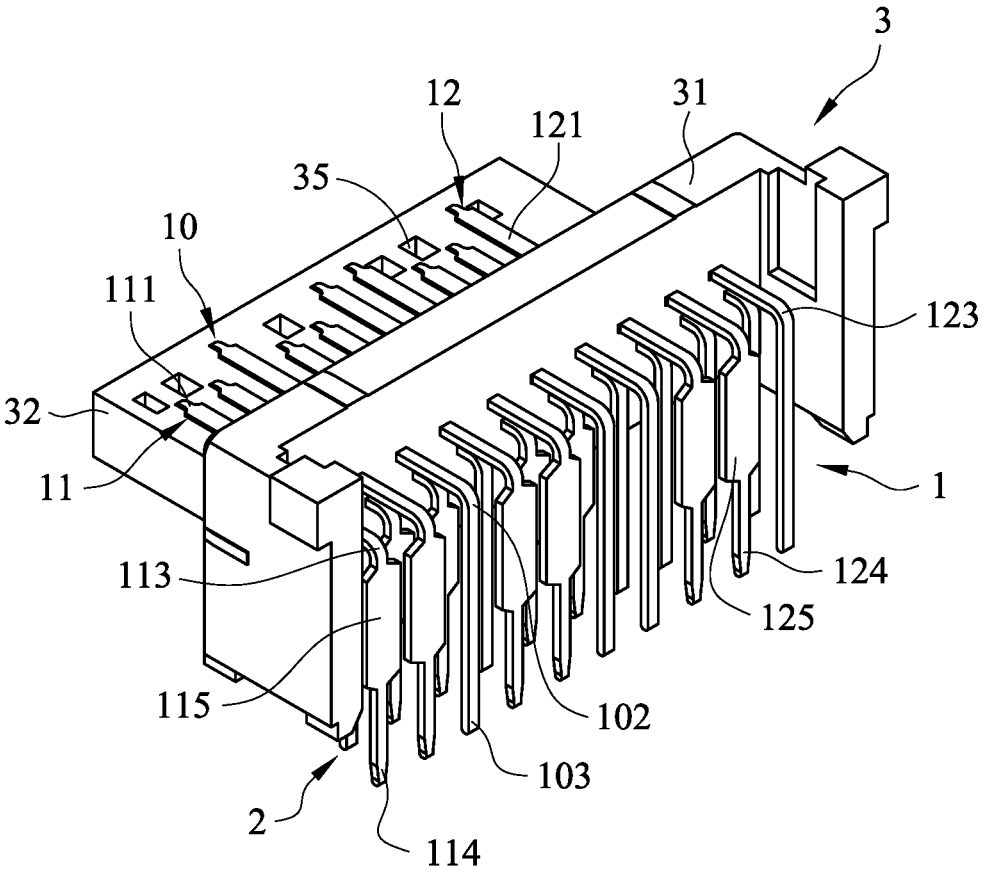
FIG. 7 is another schematic diagram showing the first and the second terminal sets after joining with the insulation seat according to the invention.
Figure 8:
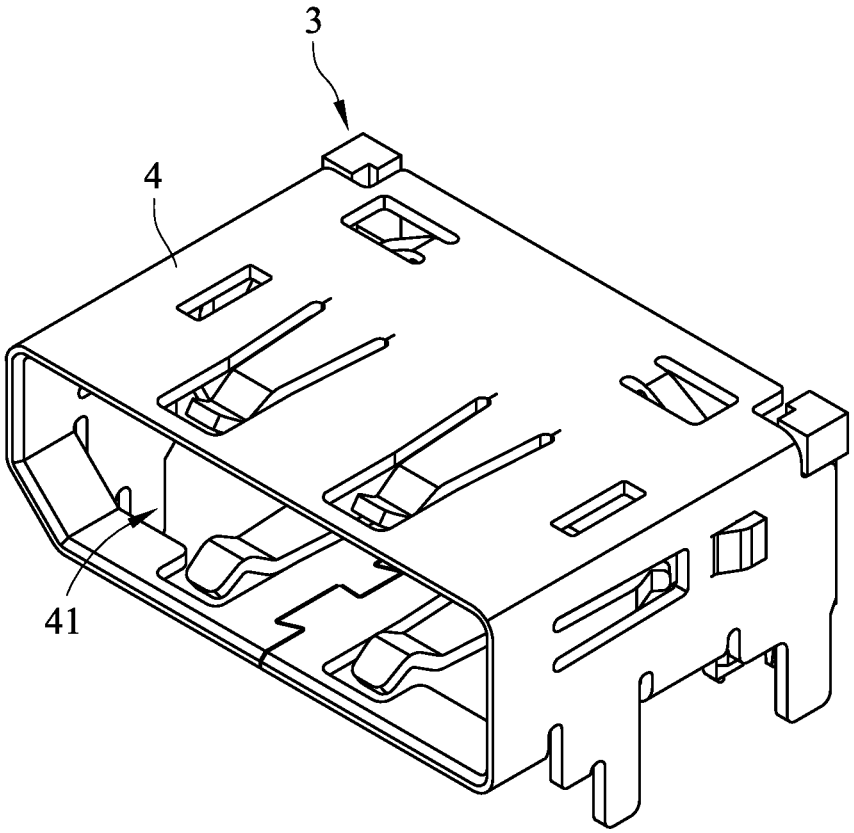
FIG. 8 is a schematic diagram showing the first and the second terminal sets, the insulation seat and the metal shell after joining according to the invention.

For thorough understanding of objectives, features and effects of the invention, the invention is described in detail as following in conjunction with attached drawings by way of preferred embodiments.

Refer to FIGS. 1, 2, 3 and 4, which are a schematic diagram showing appearance of a first and a second terminal sets according to the invention, another schematic diagram showing appearance of the first and the second terminal sets from another angle according to the invention, a schematic diagram showing appearance of the first terminal set according to the invention, and a schematic diagram showing appearance of the second terminal set according to the invention, respectively. As shown in the figures, the invention is an electrical connector with improved terminal set comprised of at least a first terminal set 1 and a second terminal set 2.

The first terminal set 1 comprises an alignment terminal 10, multiple first terminals 11 provided on one side of the alignment terminal 10, and multiple second terminals 12 provided on another side of the alignment terminal 10, the alignment terminal 10 comprising a contacting portion 101, a bending portion 102 connected with the contacting portion 101, and a welding portion 103 connected with the bending portion 102, each of the first and the second terminals 11, 12 comprising respectively a contacting portion 111, 121, a deflecting portion 112, 122 connected with the contacting portion 111, 121, a bending portion 113, 123 connected with the deflecting portion 112, 122, and a welding portion 114, 124 connected with the bending portion 113, 123, wherein the bending portion 113, 123 and the welding portion 114, 124 of part of the first terminals 11 and part of the second terminals 12 for the first terminal set 1 have a flat portion 115, 125 provided respectively therebetween which is capable of being used for signal transmission, while the terminals without the wide-flat portion 115, 125 are used for grounding, and further, the deflecting portion 112 of each of the first terminals 11 is inclined to one side of the alignment terminal 10, and the deflecting portion 122 of each of the second terminals 12 is inclined to another side of the alignment termina110.

The second terminal set 2, which is provided beneath the first terminal set 1, comprises an alignment terminal 20, multiple first terminals 21 provided on one side of the alignment terminal 20, and multiple second terminals 22 provided on another side of the alignment terminal 20, the alignment terminal 20 comprising a contacting portion 201, a bending portion 202 connected with the contacting portion 201, and a welding portion 203 connected with the bending portion 202, each of the first and the second terminals 21, 22 comprising respectively a contacting portion 211, 221, a deflecting portion 212, 222 connected with the contacting portion 211, 221, a bending portion 213, 223 connected with the deflecting portion 212, 222, and a welding portion 214, 224 connected with the bending portion 213, 223, wherein the bending portion 213, 223 and the welding portion 214, 224 of the alignment terminal 20, part of the first terminals 21 and part of the second terminals 22 for the second terminal set 2 have a respective flat portion 204, 215, 225 provided therebetween which is capable of being used for signal transmission, while the terminals without the wide-flat portion 204, 215, 225 are used for grounding, and further, the deflecting portion 212 of each of the first terminals 21 is inclined to one side of the alignment terminal 20, and the deflecting portion 222 of each of the second terminals 22 is inclined to another side of the alignment terminal 20.

Refer to FIGS. 5, 6, 7 and 8, which are an exploded schematic diagram showing elements of a first and a second terminal sets, an insulation seat and a metal shell according to the invention, a schematic diagram showing the first and the second terminal sets after joining with the insulation seat according to the invention, another schematic diagram showing the first and the second terminal sets after joining with the insulation seat according to the invention, and a schematic diagram showing the first and the second terminal sets, the insulation seat and the metal shell after joining according to the invention. As show in the figures, an insulation seat 3 and a metal shell 4 are used in conjunction for assemblage during fabrication, wherein the insulation seat 3 comprises a seat 31, a tongue plate 32 provided on an end surface of the seat 31, multiple first passageways 33 and second passageways 34 provided respectively in the seat 31 and in communication with a top surface and a bottom surface of the tongue plate 32, and multiple heat dissipating holes 35 provided on the tongue plate 32; moreover, the first and the second terminal sets 1, 2 of the invention are joined with the insulation seat 3, and the alignment terminal 10, the first terminals 11 and the second terminals 12 of the first terminal set 1 are accommodated respectively in each of the first passageways 33, while the alignment terminal 20, the first terminals 21 and the second terminals 22 of the second terminal set 2 are retained respectively in each of the second passageways 34, wherein the contacting portion 101 of the alignment terminal 10 provided by the first terminal set 1 is provided on the top surface of the tongue plate 32, and part of the contacting portion 101 is located in the first passageways 33 provided by the seat 31, while the bending portion 102 and the welding portion 103 thereof are extended out of the seat 31, and further, the contacting portion 111, 121 of each of the first and the second terminals 11, 12 provided by the first terminal set 1 is provided on the top surface of the tongue plate 32, and the deflecting portion 112, 122 is located in the first passageways 33 provided by the seat 31, while the bending portion 112, 123 and the welding portion 114, 124 are extended out of the seat 31; and furthermore, the contacting portion 201 of the alignment terminal 20 provided by the second terminal set 2 is provided on the bottom surface of the tongue plate 32, and part of the contacting portion 202 is located in the second passageways 34 provided by the seat 31, while the bending portion 202 and the welding portion 203 thereof are extended out of the seat 31, and further, the contacting portion 211, 221 of each of the first and the second terminals 21, 22 provided by the second terminal set 2 is provided on the bottom surface of the tongue plate 32, and the deflecting portion 212, 222 is located in the second passageways 34 provided by the seat 31, while the bending portion 213, 223 and the welding portion 214, 224 are extended out of the seat 31, such that the second terminal set 2 is located beneath the first terminal set 1, while the metal shell 4 covers the insulation seat 3 provided with the first terminal set and the second terminal set 1, 2, and one surface of the metal shell 4 is provided with an insertion hole 41 corresponding to the tongue plate 32. As such, an electrical connector may be constituted for a corresponding contact to be inserted via the insertion hole 41, followed by being used for heat dissipation through the heat dissipating hole 35.

When the first and the second terminal sets 1, 2 are joined with the insulation seat 3, the insulation seat 3 is fabricated by means of insert molding. Therefore, each of the first and the second terminals 11, 21, 12, 22 of the first and the second terminal sets 1, 2 may be allowed to spread from the deflecting portion 112, 212, 122, 222 on the top for the insulation seat 3 to form a smaller spreading region by using disposition of the deflecting portion 112, 212, 122, 222 when joining with each of the first and the second terminals 11, 21, 12, 22 by means of insert molding, and to fix each of the first and the second terminals 11, 21, 12, 22, such that each of the alignment terminal 10, 20, the first and the second terminals 11, 21, 12, 22 are in solid joining with the insulation seat 3, in order for the bending portion 102, 113, 123, 202, 213, 223 of each of the alignment terminal 10, 20, the first and the second terminals 11, 21, 12, 22 to be bended in a straight manner during a consecutive post process, that is, a subsequent bending process may be performed stably for a more stable production process, and each of the alignment terminal 10, 20, the first and the second terminals 11, 21, 12, 22 is in a stable and straight shape after bending, so that the performance of high frequency transmission may also be controlled stably.

Each of the first and the second terminals 11, 21, 12, 22 of the invention forms a spreading configuration where the deflecting portion 112, 212, 122, 222 is on the top portion, so that the insulation seat 3 may utilize the shape of each of the deflecting portion 112, 212, 122, 222 when joining with each of the first and the second terminals 11, 21, 12, 22 by means of insert molding for each of the alignment terminal 10, 20, the first and the second terminals 11, 21, 12, 22 to form a smaller spreading region therebetween after covering to the seat 31, such that the insulation seat 3 is better to control during punching production. Moreover, after each of the first and the second terminals 11, 21, 12, 22 are joined with the insulation seat 3 by means of insert molding, the bending portion 102, 113, 123, 202, 213, 223 of each of the alignment terminal 10, 20, the first and the second terminals 11, 21, 12, 22 is in a non-bending state. In such state, each of the deflecting portion 112, 212, 122, 222 is located on the top of each of the first and the second terminals 11, 21, 12, 22. That is, a spreading configuration is formed in front of the bending portion 113, 123, 213, 223. Thus, the bending portion 102, 113, 123, 202, 213, 223 of each of the alignment terminal 10, 20, the first and the second terminals 11, 21, 12, 22 may be bended in a straight manner during a post process without the manner of bending in a deflection manner as the prior art, so that the production process may be more stable and the high frequency transmission may also be controlled stably.

Figure 9:
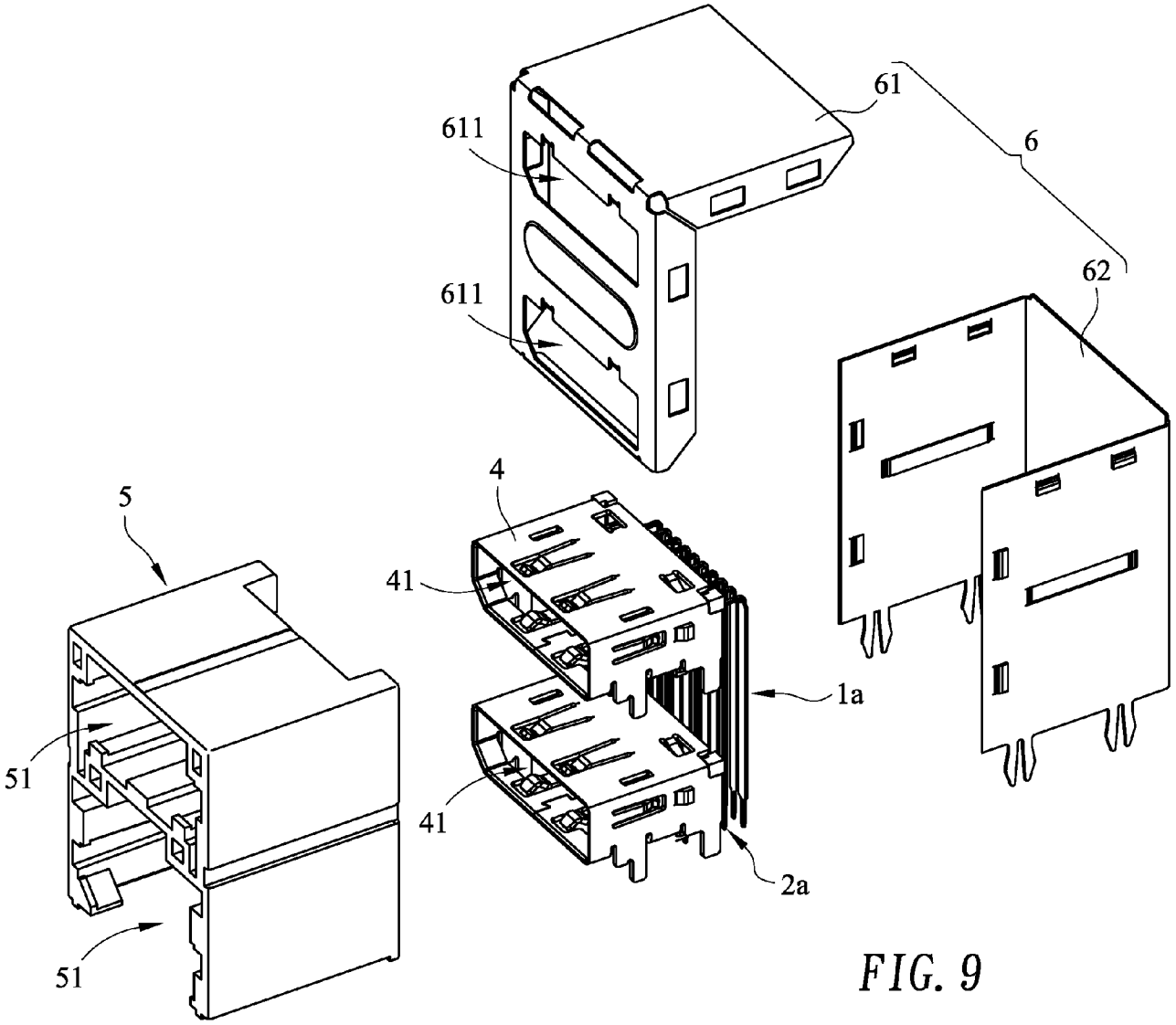
FIG. 9 is an exploded schematic diagram showing elements of another preferred embodiment according to the invention.
Figure 10:
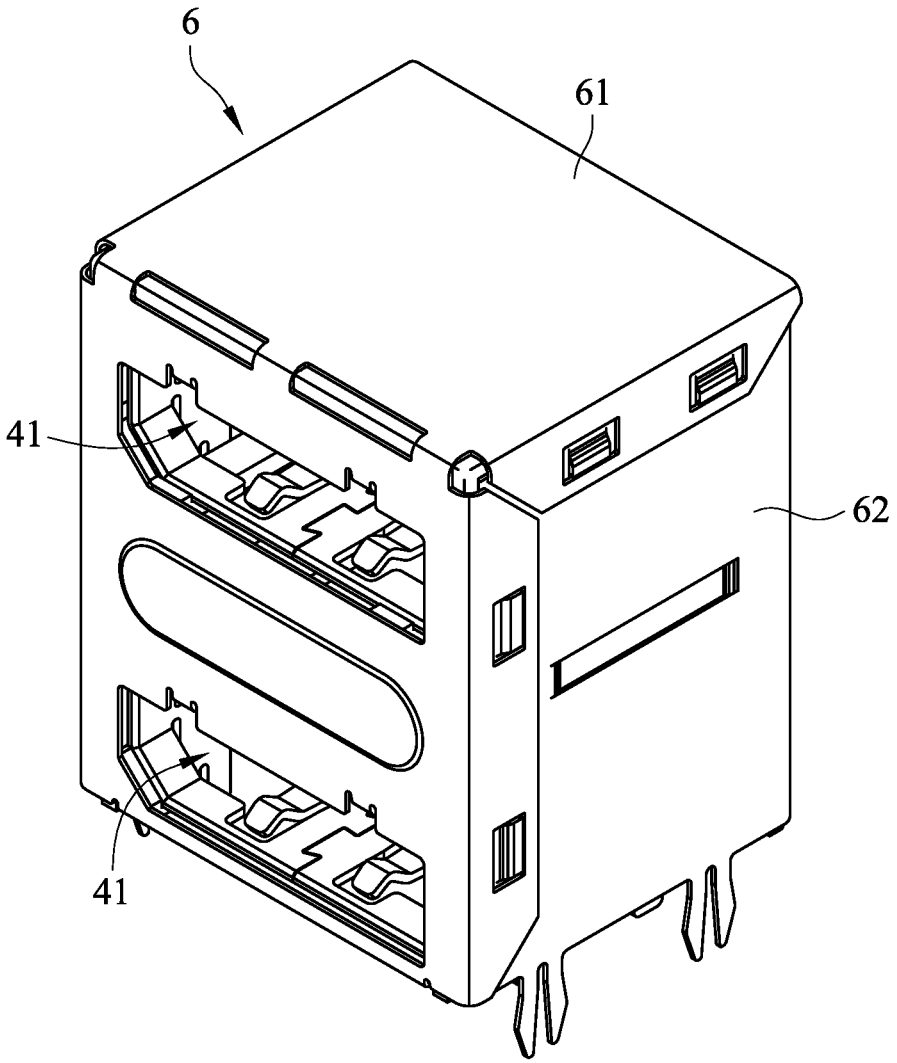
FIG. 10 is a schematic diagram showing appearance of another preferred embodiment according to the invention.

Refer to FIGS. 9 and 10, which are an exploded schematic diagram showing elements of another preferred embodiment according to the invention, and a schematic diagram showing appearance of another preferred embodiment according to the invention, respectively. As shown in the figures, in addition to the single layer electrical connector structure shown in FIGS. 5 to 8 as described above, the invention may also be of a double-layer electrical connector structure in this embodiment with difference in that the first and the second terminal sets 1*a*, 2*a* are made with larger length to act as upper layer, while the original connector is used as lower layer, followed by disposing respectively the upper, lower layer electrical connectors on upper, lower containing areas 51 of a fixing seat 5, and finally, a front shell 61 and a rear shell 62 of an outer shell 6 are used to cover the fixing seat 5, and a surface of the front shell 61 is provided with corresponding holes 611 corresponding to the insertion holes 41 provided by the upper, lower layer electrical connectors thereon, such that a double-layer electrical connector is constituted.

In summary, according to the description disclosed above, the invention can achieve the preferred objective of the invention. Each of the first and the second terminals is allowed to spread from the deflecting portion on the top for the insulation seat to form a smaller spreading region when joining with each of the first and the second terminals by means of insert molding, such that punching production process can be controlled easily, and in turn, disposition of each of the deflecting portions is utilized for solid joining with the insulation seat, and the bending portion is allowed to be bended in a straight manner during a consecutive post process in order to proceed to a subsequent bending process for each of the first and the second terminals, so that the effects with respect to more stable production and better control of high frequency characteristics are accomplished.

While the description above are only preferred embodiments of the invention. Any equivalent modification made within the scope of the claims of the invention shall be within the substantial scope of the invention.

What is claimed is:

1. An electrical connector with improved terminal set, including:

a first terminal set, which is joined with an insulation seat, comprising an alignment terminal, multiple first terminals provided on one side of the alignment terminal, and multiple second terminals provided on another side of the alignment terminal, the alignment terminal comprising a portion of contacting portion in the insulation seat, a bending portion connected with the contacting portion, and a welding portion connected with the bending portion, and moreover, each of the first and the second terminals comprising respectively a contacting portion, a deflecting portion connected with the contacting portion and located in the insulation seat, a bending portion connected with the deflecting portion, and a welding portion connected with the bending portion;

a second terminal set, which is joined with the insulation seat and located beneath the first terminal set, comprising an alignment terminal, multiple first terminals provided on one side of the alignment terminal, and multiple second terminals provided on another side of the alignment terminal, the alignment terminal comprising a portion of contacting portion in the insulation seat, a bending portion connected with the contacting portion, and a welding portion connected with the bending portion, and moreover, each of the first and the second terminals comprising respectively a contacting portion, a deflecting portion connected with the contacting portion and located in the insulation seat, a bending portion connected with the deflecting portion, and a welding portion connected with the bending portion; and a metal shell covering the insulation seat, the first terminal set and the second terminal set; thereby, each of the first and the second terminals is allowed to spread from the deflecting portion on the top for the insulation seat to form a smaller spreading region when joining with each of the first and the second terminals by means for inserting molding, such that a punching production process is easy to control, and the bending portion can be bended in a straight manner during a consecutive post process, so that a more stable production process and the high frequency transmission performance can be controlled stably; wherein the insulation seat comprises a seat, a tongue plate provided on an end surface of the seat, multiple first passageways and second passageways provided respectively in the seat and in communication with a top surface and a bottom surface of the tongue plate, and multiple heat dissipating holes provided on the tongue plate; the alignment terminal, the first terminals and the second terminals of the first terminal set being retained respectively in each of the first passageways, and the alignment terminal, the first terminals and the second terminals of the second terminal set being retained respectively in each of the second passageways.

2. The electrical connector with improved terminal set according to claim 1, wherein the contacting portion of the alignment terminal provided by the first terminal set is provided on the top surface of the tongue plate, and part of the contacting portion is located in the first passageways of the seat, the bending portion and the welding portion thereof extending out of the seat.

3. The electrical connector with improved terminal set according to claim 1, wherein the contacting portion of each of the first and the second terminals provided by the first terminal set is provided on the top surface of the tongue plate, and the deflecting portion is located in the first passageways of the seat, the bending portion and the welding portion thereof extending out of the seat.

4. The electrical connector with improved terminal set according to claim 1, wherein the contacting portion of the alignment terminal provided by the second terminal set is provided on the bottom surface of the tongue plate, and part of the contacting portion is located in the second passageways of the seat, the bending portion and the welding portion thereof extending out of the seat.

5. The electrical connector with improved terminal set according to claim 1, wherein the contacting portion of each of the first and the second terminals provided by the second terminal set is provided on the bottom surface of the tongue plate, and the deflecting portion is located in the second passageways of the seat, the bending portion and the welding portion thereof extending out of the seat.

6. The electrical connector with improved terminal set according to claim 1, wherein the bending portion and the welding portion of part of the first terminals and part of the second terminals for the first terminal set have a respective flat portion provided therebetween which is used for signal transmission.

7. The electrical connector with improved terminal set according to claim 1, wherein the deflecting portion of each of the first terminals provided by the first terminal set is inclined to one side of the alignment terminal, while the deflecting portion of each of the second terminals provided by the first terminal set is inclined to the other side of the alignment terminal.

8. The electrical connector with improved terminal set according to claim 1, wherein the bending portion and the welding portion of the alignment terminal, part of the first terminals and part of the second terminals for the second terminal set have a flat portion provided respectively therebetween which is used for signal transmission.

9. The electrical connector with improved terminal set according to claim 1, wherein the deflecting portion of each of the first terminals provided by the second terminal set is inclined to one side of the alignment terminal, while the deflecting portion of each of the second terminals provided by the second terminal set is inclined to the other side of the alignment terminal.

10. An electrical connector with improved terminal set, wherein the terminal set includes:

a first terminal set comprising an alignment terminal, multiple first terminals provided on one side of the alignment terminal, and multiple second terminals provided on another side of the alignment terminal, the alignment terminal comprising a contacting portion, a bending portion connected with the contacting portion, and a welding portion connected with the bending portion, and moreover, each of the first and the second terminals comprising respectively a contacting portion, a deflecting portion connected with the contacting portion, a bending portion connected with the deflecting portion, and a welding portion connected with the bending portion; and a second terminal set, which is provided beneath the first terminal set, comprising an alignment terminal, multiple first terminals provided on one side of the alignment terminal, and multiple second terminals provided on another side of the alignment terminal, the alignment terminal comprising a contacting portion, a bending portion connected with the contacting portion, and a welding portion connected with the bending portion, and moreover, each of the first and the second terminals comprising respectively a contacting portion, a deflecting portion connected with the contacting portion, a bending portion connected with the deflecting portion, and a welding portion connected with the bending portion; thereby, each of the first and the second terminals is allowed to spread from the deflecting portion on the top to form a smaller spreading region when joining with each of the first and the second terminals by means for inserting molding in conjunction with the insulation seat, such that a punching production process is easy to control, and the bending portion can be bended in a straight manner during a consecutive post process, so that a more stable production process and the high frequency transmission performance can be controlled stably; wherein the insulation seat comprises a seat, a tongue plate provided on an end surface of the seat, multiple first passageways and second passageways provided respectively in the seat and in communication with a top surface and a bottom surface of the tongue plate, and multiple heat dissipating holes provided on the tongue plate; the alignment terminal, the first terminals and the second terminals of the first terminal set being retained respectively in each of the first passageways, and the alignment terminal, the first terminals and the second terminals of the second terminal set being retained respectively in each of the second passageways.

* * * * *